US007975861B2

(12) United States Patent
Rieppel

(10) Patent No.: US 7,975,861 B2
(45) Date of Patent: Jul. 12, 2011

(54) BABY FEEDING BOTTLE WITH ENHANCED FLOW CHARACTERISTICS

(76) Inventor: Michele Rieppel, Mansfield, PA (US)

( * ) Notice: Subject to any disclaimer, the term of this patent is extended or adjusted under 35 U.S.C. 154(b) by 496 days.

(21) Appl. No.: 12/183,131

(22) Filed: Jul. 31, 2008

(65) Prior Publication Data

US 2010/0025352 A1 Feb. 4, 2010

(51) Int. Cl.
*A61J 9/00* (2006.01)

(52) U.S. Cl. ..... 215/11.4

(58) Field of Classification Search ..... 215/114.4, 215/11.3, 11.6, 11.1, 313, 311, 310, 200; 220/495.03, 495.06, 253, 714, 713, 711, 220/703, 203.05, 203.04, 203.02, 203.01, 220/203.19, 200; 222/547, 544, 570, 567, 222/532, 531, 526; 606/236; D9/563, 450, D9/449, 447, 435; D7/315, 312, 300
See application file for complete search history.

(56) References Cited

U.S. PATENT DOCUMENTS 3,139,064 A * 6/1964 Harle ..... 116/309
5,211,300 A * 5/1993 Hsing et al. ..... 215/11.4
6,161,710 A * 12/2000 Dieringer et al. ..... 215/11.4
6,966,904 B2 11/2005 Ruth et al.
7,320,678 B2 1/2008 Ruth et al.
2004/0026351 A1* 2/2004 Dunn et al. ..... 215/11.1
2004/0245203 A1* 12/2004 Goldman et al. ..... 215/11.4
2005/0184022 A1* 8/2005 Dunn et al. ..... 215/11.5
2005/0199637 A1* 9/2005 Wong ..... 220/714

* cited by examiner

*Primary Examiner* — Anthony Stashick
*Assistant Examiner* — Robert J Hicks
(74) *Attorney, Agent, or Firm* — Renner, Otto, Boisselle & Sklar, LLP

(57) ABSTRACT

A feeding assembly for a baby bottle includes a bottom nipple secured at the top of a bottle base, and having an outlet for providing a maximum flow rate of a feeding liquid. A middle nipple may be provided over the bottom nipple including a plurality of selectable setting outlets, each of which corresponds to a different flow rate setting. The bottle is adjustable, and may be adjusted in use, so that a setting outlet corresponding to a single flow rate setting at a time may receive liquid from the first nipple. In this manner, the maximum flow from the first nipple may be reduced by a setting outlet corresponding to one of the flow rate settings. A top nipple may be provided over the second nipple from which an infant may feed.

20 Claims, 7 Drawing Sheets

Isometric view
Scale: 1:1

Isometric view
Scale: 1:1

Front view
Scale: 1:1

Top view
Scale: 1:1

Front view
Scale: 1:1

Top view
Scale: 1:1

Isometric view
Scale: 1:1

Bottom view
Scale: 1:1

Front view
Scale: 1:1

Isometric view
Scale: 1:1

Top view
Scale: 1:1

Front view
Scale: 1:1

Isometric view
Scale: 1:1

Top view
Scale: 1:1

BABY FEEDING BOTTLE WITH ENHANCED FLOW CHARACTERISTICS

TECHNICAL FIELD OF THE INVENTION

The technology of the present disclosure relates generally to a baby feeding bottle, and more particularly to a baby feeding bottle having enhanced flow characteristics to adjust the flow of a feeding liquid to accommodate different feeding capacities.

DESCRIPTION OF THE RELATED ART

Baby feeding bottles are known in the art, and, despite the increase in breastfeeding, bottles still commonly are used for feeding. Indeed, baby feeding bottles may be necessary in certain circumstances. For example, premature babies in a neonatal intensive care unit (N.I.C.U.) sometimes are not born with a sufficient suck-swallow-breathe reflex needed for breastfeeding. In addition, N.I.C.U. babies that are breastfed may need supplemental bottle feedings in circumstances when the mother may not be capable of or available for every feeding.

Even outside the hospital setting, bottle feeding may be desirable at times. Newborns that are "lazy nursers" may need supplemental bottle feedings in addition to breastfeeding. In addition, intermittent or occasional bottle feedings may aid bonding between newborns and a father, and otherwise may permit a non-parent caretaker to feed an infant when a mother is not present or available for breastfeeding. Mothers also may wish to provide supplemental bottle feedings at times or locations when breastfeeding may be uncomfortable. Bottles used for supplemental feedings may have a nipple with a hole configuration to mimic a woman's breast. In this manner, feeding behavior disruptions caused by switching between breast and bottle feedings may be reduced.

For hospitals and other healthcare centers, daycare centers, and other locations that care for numerous infants at once, bottles may be washed and sterilized, and reused. Often, infants at different stages of development may have different feeding needs and capacities. For example, a premature infant may have a relatively low feeding need and capability as compared to an infant who is six months old. It is desirable, therefore, to provide a bottle with a liquid flow that is commensurate with an infant's developmental stage and feeding capacity. A premature infant with deficient feeding reflexes may be provided a bottle with a minimal flow rate, while a healthy newborn may be provided with a bottle having an intermediate flow rate, and an older infant may be provided with a bottle having an advanced flow rate. Even as to a single infant, parents may recognize a similar change in feeding behavior as the infant develops, commensurately necessitating different bottle feeding flow rates.

One way to accommodate different bottle flow rates is simply to maintain an inventory of bottles and/or bottle components (such as nipples and tops) having different flow rates. A given bottle may be selected or assembled from components to meet a given infant's feeding needs and capacity. Maintaining such an inventory, however, may be inconvenient and expensive, particularly in healthcare or daycare facilities that care for numerous infants at varying developmental stages. Even as to an individual household with one (or perhaps up to a few) infants at a time, multiple bottles or components may be purchased and maintained to accommodate a growing infant, similarly creating added inconvenience and expense.

Attempts have been made at creating a bottle with an adjustable flow rate to accommodate different feeding capacities with one bottle. Conventionally, adjustable bottles employ a valve system to change the flow rate depending upon the feeding circumstances. Although valve bottles may reduce the need for a large inventory of bottles or components, they have other deficiencies. The valve systems typically contain various moving parts, rendering them relatively difficult and expensive to manufacture. In addition, the valve components provide numerous potential failure points, which may require the replacement of parts and other maintenance. This adds to the expense and inconvenience of valve systems for baby feeding bottles.

SUMMARY

To improve the user experience with baby feeding bottles, there is a need in the art for an improved, adjustable flow baby feeding bottle that provides adjustable flow without a complex valve system. An exemplary baby feeding bottle of the present disclosure includes a bottle base having a fluid container, and a feeding assembly from which an infant feeds.

The feeding assembly may include a configuration of three sandwiched or stacked nipples. A first or bottom nipple may be secured at the top of the bottle base, and may have an outlet for providing a maximum flow rate of a feeding fluid. A second or middle nipple may be positioned over the first (bottom) nipple to receive the fluid from the first nipple. The middle nipple may include multiple selectable setting outlets, each of which provides a different flow rate setting. The bottle is adjustable so that a setting outlet corresponding to a single flow rate setting at a time may receive the fluid from the first nipple. In this manner, the maximum flow from the first nipple may be constricted or reduced by a setting outlet of the middle nipple corresponding to a particular flow rate setting. In addition, the flow rate setting may be changed in-use or prior to use to attain varying flow rates, each corresponding to a flow rate setting. In this manner, the bottle may accommodate varying feeding capacities of numerous infants. A third or top nipple may be positioned over the second nipple from which an infant may feed.

Therefore, according to one aspect of the invention, a baby bottle comprises a base including a container for containing a fluid, a first nipple secured to the base for receiving the fluid from the container, and a second nipple positioned to receive the fluid from the first nipple. The fluid is transferred through a tip of the first nipple to the second nipple at a first flow rate, and the fluid is transferred through a tip of the second nipple at a second flow rate different from the first flow rate.

According to one embodiment of the baby bottle, the tip of the second nipple comprises a plurality of selectable setting outlets, each outlet corresponding to a different second flow rate such that when one of the setting outlets is selected, fluid flows through the selected setting outlet at its corresponding flow rate.

According to one embodiment of the baby bottle, the tip of the second nipple includes three setting outlets corresponding respectively to a low flow rate, an intermediate flow rate, and a high flow rate.

According to one embodiment of the baby bottle, the tip of the second nipple further includes a closed portion corresponding to a fourth setting in which flow of the fluid is prohibited.

According to one embodiment of the baby bottle, the first flow rate through the tip of the first nipple is equal to or exceeds the high flow rate.

According to one embodiment of the baby bottle, the first nipple is rotated relative to the second nipple to select one of the setting outlets.

According to one embodiment of the baby bottle, the tip of the first nipple includes an outlet positioned off center, and one of the setting outlets is selected by rotating the first nipple relative to the second nipple to align the outlet of the first nipple with the selected setting outlet of the second nipple.

According to one embodiment of the baby bottle, the first nipple is rigidly secured to the base, and the base is rotated relative to the second nipple to select one of the setting outlets.

According to one embodiment of the baby bottle, the baby bottle further comprises a fastening ring that is rigidly secured to the second nipple, and the fastening ring is longitudinally secured to the base in a manner that permits the fastening ring to rotate relative to the base, wherein the base is rotated relative to the fastening ring to select one of the setting outlets.

According to one embodiment of the baby bottle, the base is rotated relative to the fastening ring to select one of the setting outlets while in use during a feeding.

According to one embodiment of the baby bottle, the baby bottle further comprises a fastening ring that is secured to the second nipple, and the fastening ring is longitudinally secured to the base to position the second nipple above the first nipple.

According to one embodiment of the baby bottle, the baby bottle further comprises a third nipple secured to the fastening ring above the second nipple for receiving fluid from the second nipple, the third nipple including a feeding outlet.

According to one embodiment of the baby bottle, the feeding outlet has a plurality of holes configured to mimic a human breast nipple to approximate breast feeding.

According to another aspect of the invention, a feeding assembly for a baby bottle comprises a first nipple for receiving a fluid from a container, and a second nipple positioned to receive the fluid from the first nipple. The fluid is transferred through a tip of the first nipple to the second nipple at a first flow rate, and the fluid is transferred through a tip of the second nipple at a second flow rate different from the first flow rate.

According to one embodiment of the feeding assembly, the tip of the second nipple comprises a plurality of selectable setting outlets, each outlet corresponding to a different second flow rate such that when one of the setting outlets is selected, fluid flows through the selected setting outlet at its corresponding flow rate.

According to one embodiment of the feeding assembly, the tip of the second nipple includes three setting outlets corresponding respectively to a low flow rate, an intermediate flow rate, and a high flow rate.

According to one embodiment of the feeding assembly, the tip of the second nipple further includes a closed portion corresponding to a fourth setting in which flow of the fluid is prohibited.

According to one embodiment of the feeding assembly, the first flow rate through the tip of the first nipple is equal to or exceeds the high flow rate.

According to one embodiment of the feeding assembly, the first nipple is rotated relative to the second nipple to select one of the setting outlets.

According to one embodiment of the feeding assembly, the tip of the first nipple includes an outlet positioned off center, and one of the setting outlets is selected by rotating the first nipple relative to the second nipple to align the outlet of the first nipple with the selected setting outlet of the second nipple.

According to one embodiment of the feeding assembly, the feeding assembly further comprises a fastening ring that is rigidly secured to the second nipple, wherein the first nipple is rotated relative to the fastening ring to select one of the setting outlets.

According to one embodiment of the feeding assembly, the feeding assembly further comprises a fastening ring that is secured to the second nipple to position the second nipple above the first nipple.

According to one embodiment of the feeding assembly, the feeding assembly further comprises a third nipple secured to the fastening ring above the second nipple for receiving the fluid from the second nipple, the third nipple including a feeding outlet.

According to another aspect of the invention, a nipple for a baby bottle comprises a generally conical frame, a concave mid portion above the conical frame, and a tip above the mid portion having a feeding outlet from which an infant may feed.

According to one embodiment of the nipple, the concave mid portion has a curvature opposite to the curvature of the conical frame.

According to one embodiment of the nipple, the feeding outlet has a plurality of holes configured to mimic a human breast nipple to approximate breast feeding.

According to one embodiment of the nipple, the length of the breast nipple is 34.1 millimeters (1 5/16 inches) or less.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto.

Features that are described and/or illustrated with respect to one embodiment may be used in the same way or in a similar way in one or more other embodiments and/or in combination with or instead of the features of the other embodiments.

DETAILED DESCRIPTION OF EMBODIMENTS

Figure 1:
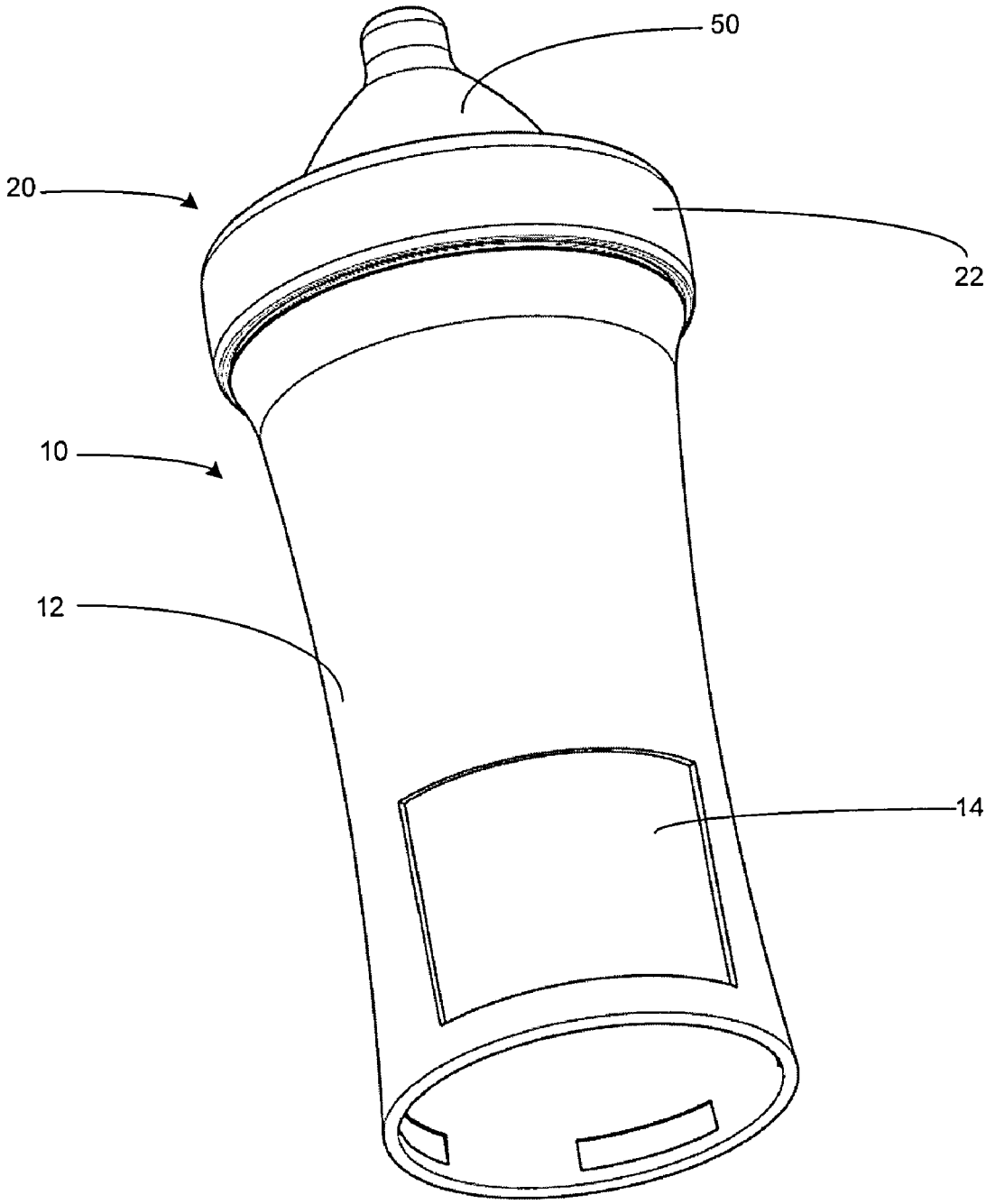
FIG. 1 is a schematic isometric view of an exemplary baby feeding bottle.

As described in more detail below, in one embodiment the bottle of the present disclosure has a configuration including a base having a feeding container, and a feeding assembly.

The feeding assembly may include three sandwiched or stack nipples. A first or bottom nipple may be secured to the top of a base of the bottle, and may have an outlet for providing a maximum flow rate of a feeding fluid, such as breast milk. A second or middle nipple may be positioned over the first (bottom) nipple to receive the fluid from the bottom nipple. The middle nipple may include multiple selectable setting outlets, each of which provides a different flow rate setting. The bottle is adjustable so that a particular setting outlet corresponding to a single flow rate setting at a time may receive fluid from the first nipple. In this manner, the maximum flow from the first nipple may be constricted or reduced by a setting outlet of the middle nipple corresponding to a specific flow rate setting. In addition, the flow rate setting may be changed to attain varying flow rates, each corresponding to a distinct flow rate setting. A third or top nipple may be positioned over the second (middle) nipple to receive the fluid from the middle nipple. An infant feeds from this top nipple, and, therefore, the top nipple may be configured to mimic the texture and feel of a human breast to approximate breast feeding.

Embodiments of the present invention will now be described with reference to the drawings, wherein like reference numerals are used to refer to like elements throughout. It will be understood that the figures are not necessarily to scale.

FIG. 1 is a schematic isometric view of an exemplary baby feeding bottle 10. The feeding bottle 10 includes a base 12 and a feeding assembly 20. As shown, the base 12 is a hollow cylindrical casing for including or receiving a container for containing a feeding fluid, such as a conventional feeding liner (not shown in this figure). The feeding fluid may be breast milk, formula, juice, water, etc. In an alternative embodiment, the base 12 may be a closed cylinder and itself constitute the container for the feeding fluid. The base may contain a label area 14 for displaying indentifying information. For example, a user may write a name of an infant for whom the bottle is intended with an erasable writing instrument. Other forms of the label area may be employed. For example, the label area may comprise a transparent window for receiving an interchangeable label containing the identifying information. The label area is particularly useful in healthcare and other care centers in which the bottle may be sterilized and reused for numerous infants.

The bottle 10 may include a feeding assembly 20 having a top nipple 50 with a feeding outlet from which an infant may feed. As further described below, the feeding assembly may contain multiple nipples, of which only the outermost top nipple 50 is viewable in FIG. 1. The feeding assembly 20 may also include a fastening ring 22 for securing the nipples to the bottle base 12.

The bottle 10 and its constituent components, base 12 and feeding assembly 20 (and sub-components thereof), may be made of various suitable materials as are known in the art. For example, appropriate materials may include polyethersulfone (PES), polyactide, polyamide (PA), polypropylene (PP), and/or hospital grade silicone. Of note, the bottle of the present disclosure may be manufactured without the use of Bisphenol A (BPA), which in some scientific studies has been linked to certain hazardous effects including "estrogenicity", or the presence of estrogen-like compounds in the breast milk or other feeding liquid resulting from heating a bottle made with BPA.

Figure 2:
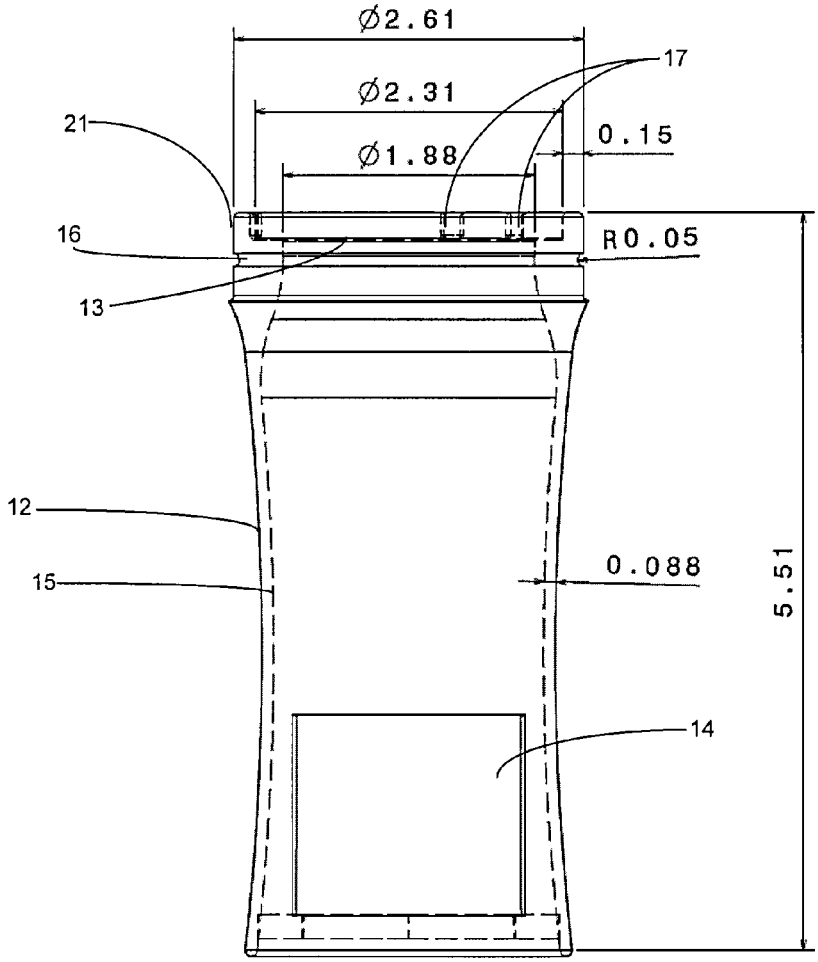
FIG. 2 depicts a schematic front view of an exemplary base of the bottle of FIG. 1.

FIG. 2 depicts a schematic front view of an exemplary base 12 of the bottle 10. The base 12 includes a ridge 13 for receiving a feeding liner 15 as is conventional. The feeding liner typically is positioned within the base 12, and, therefore, the outline of the feeding liner is shown by the dashed lines of FIG. 2. As stated above, the bottle need not use a feeding liner. Rather, the base 12 may be a closed cylinder that itself constitutes a container for receiving a feeding fluid. The base 12 also may include a circumferential groove 16 for cooperating with a ridge of the fastening ring 22 (not shown in this figure). Although FIG. 2 identifies dimensions in inches of the various features of base 12, it will be appreciated that those dimensions are exemplary and may be varied.

Base 12 also may include notches 17. In this embodiment, the base contains three notches, although the precise number of notches may be varied. As further described below, the notches 17 may cooperate with corresponding protrusions on the first (bottom) nipple to secure the bottom nipple to the bottle base.

Figure 3:
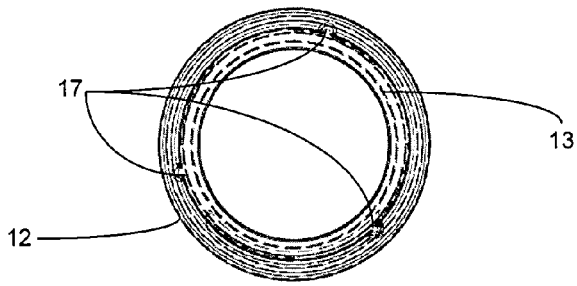
FIG. 3 depicts a top view of the exemplary bottle base of FIG. 2.

FIG. 3 depicts a top view of the base 12 of the bottle 10. FIG. 3 provides an additional view of the ridge 13 for receiving the feeding liner, and the notches 17 for positioning and securing the bottom nipple.

Figure 4A:
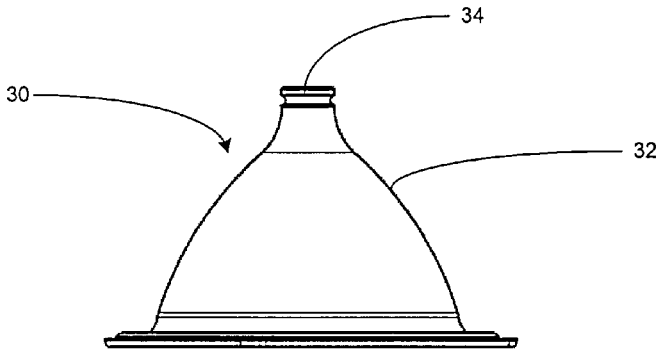
FIGS. 4A-4C are schematic diagrams of various views of an exemplary first or bottom nipple.
Figure 4B:
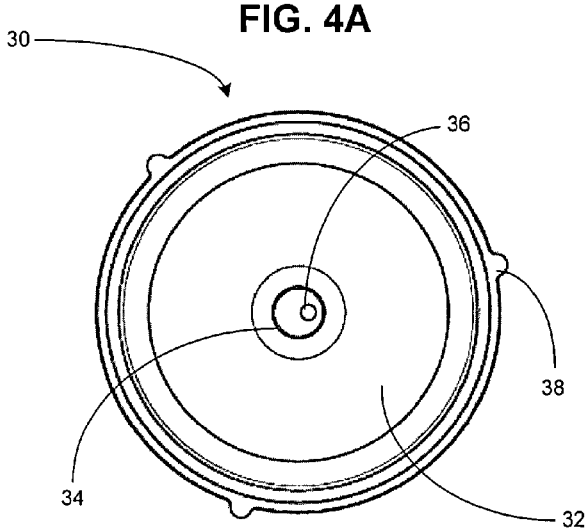
Figure 4C:
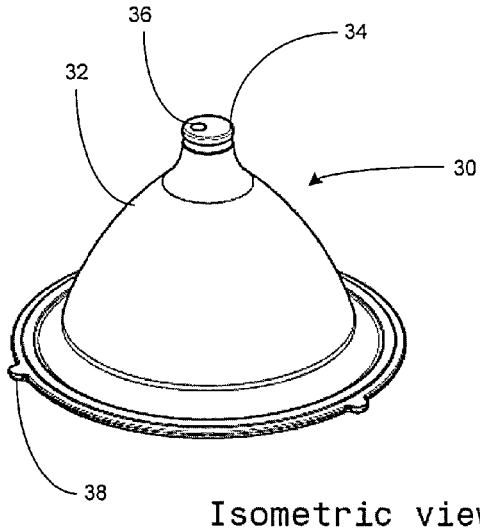
Figure 5A:
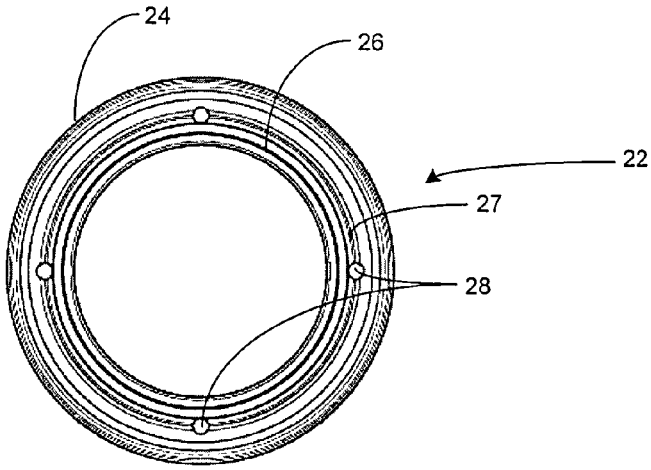
FIGS. 5A-5D are schematic diagrams of various views of an exemplary fastening ring.
Figure 5B:
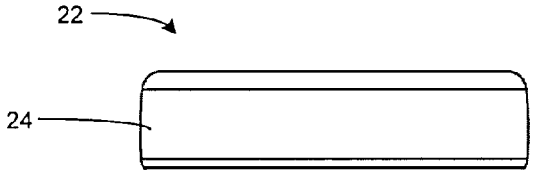
Figure 5D:
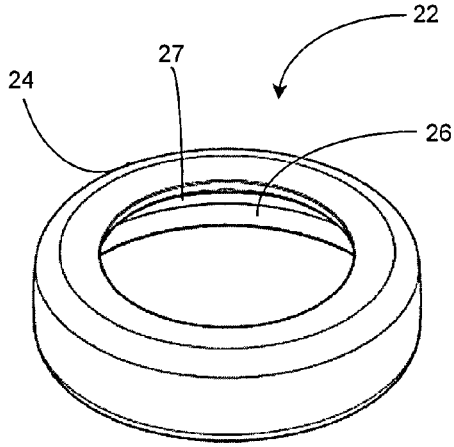
Figure 5C:
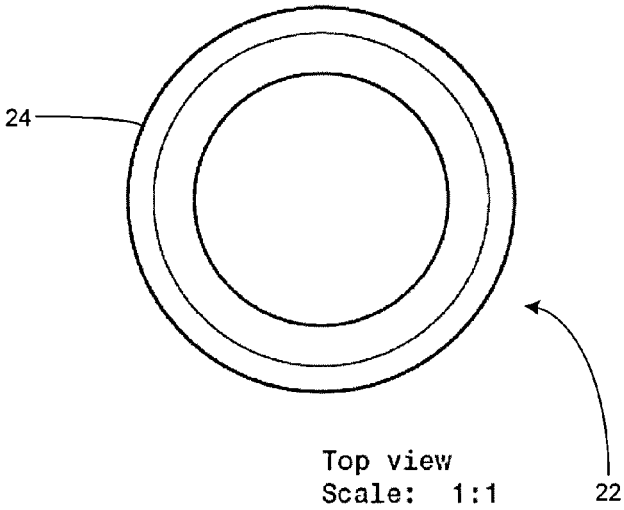

FIGS. 4A-4C are schematic diagrams of various views of an exemplary first or bottom nipple 30. The first nipple has a generally conical frame 32 and a tip 34 as is conventional for a baby bottle nipple. Fluid may flow into the bottom nipple from the container, and then to the tip 34. The tip 34 includes an outlet 36 to permit the passage of fluid out of the tip of the bottom nipple. The outlet 36 is configured off-center of the tip 34 and provides a "maximum flow rate" of fluid through the bottom nipple. As used herein, the term "maximum flow rate" is a relative term, meaning that the flow rate through the bottom nipple is at least as large or larger than the flow rate through the other nipples of the feeding assembly, as further described below.

The bottom nipple 30 may include one or more protrusions 38 that may cooperate with the notches 17 of the bottle base 12 (see FIGS. 2 and 3). Although in FIGS. 4A-4C three semicircular shaped protrusions are shown, it will be appreciated that the number and shape of the protrusions may vary. Preferably, the number of protrusions 38 equals the number of notches 17, and their shape and positioning permits mating of the structures. Thus, the protrusions 38 may cooperate with the notches 17 to fix the bottom nipple to the bottle base in a substantially rigid fashion by which the bottom nipple and bottle base may be moved as a single piece. For example, rotation of the bottle base results in a commensurate rotation of the bottom nipple. To fix the bottom nipple to the bottle base, the protrusions may be snapped or pressed into the notches, adhered with an adhesive, or by any conventional means of rigidly securing one part to another part. In one embodiment, the bottom nipple is rigidly fixed to the bottle base with respect to forces occurring in use, but a user may remove the bottom nipple by applying a removing force. For example, if the bottom nipple is snapped into the bottle base, a user may "pop out" the nipple from the bottle base. Removability has an advantage of permitting more thorough cleaning of the components.

FIGS. 5A-5D are schematic diagrams of an exemplary fastening ring 22. The fastening ring 22 has a frame 24 that is open at the top and bottom. As seen in the figures, the top opening is smaller than the bottom opening, although the precise configuration of the fastening ring may vary. The fastening ring 22 may include a circumferential ridge 26 that cooperates with the circumferential groove 16 of the bottle base 12 (see FIG. 2) to secure the fastening ring longitudinally to the bottle base. For example, the fastening ring 22 may be snapped over an upper portion 21 (see also FIG. 2) of the bottle base 12 such that ridge 26 rests within the groove 16 of the bottle base. This configuration substantially prevents longitudinal separation of the fastening ring from the bottle base in response to forces occurring in use, but a user may remove the fastening ring by applying a removing force. For example, a user may longitudinally "pop off" the fastening ring from the bottle base, which permits more thorough cleaning of the components. It will be appreciated that when the bottom nipple is first snapped into the bottle base, the fastening ring fits over the bottom nipple such that the tip 34 of the bottom nipple protrudes through the fastening ring.

Note, however, that the fastening ring is not secured fully rigidly with respect to the bottle base. In particular, the bottle base may be rotated relative to the fastening ring, and vice versa. The manufacturing materials described above permit the ridge 26 to slide within the groove 16 to permit relative rotation of the bottle base with respect to the fastening ring. For example, if a holding force is applied to the fastening ring to prevent its motion, the bottle base (with the secured bottom nipple) may be rotated or turned relative to the fastening ring. The holding force may be applied by a user who holds the fastening ring motionless while turning the bottle base. In addition, a holding force may constitute a holding pressure of a suckling infant which holds the fastening ring in place. A user (parent or other caretaker) may then turn the bottle base during feeding to alter the fluid flow as needed, as further described below.

In addition, the fastening ring 22 may include a lip 27 having one or more fastening holes 28. In the example of FIGS. 5A-5D, four fastening holes are provided and spaced equally about the circumference of the lip 27. The precise number and positioning of the fastening holes, however, may be varied. The fastening holes 28 may receive fastening extensions from a second nipple (described below) to secure the fastening ring to the second nipple in a substantially rigid manner during use. The lip 27 may be positioned above the ridge 26 to prevent interference with the connection between the fastening ring and the bottle base via the groove 16.

Figure 6A:
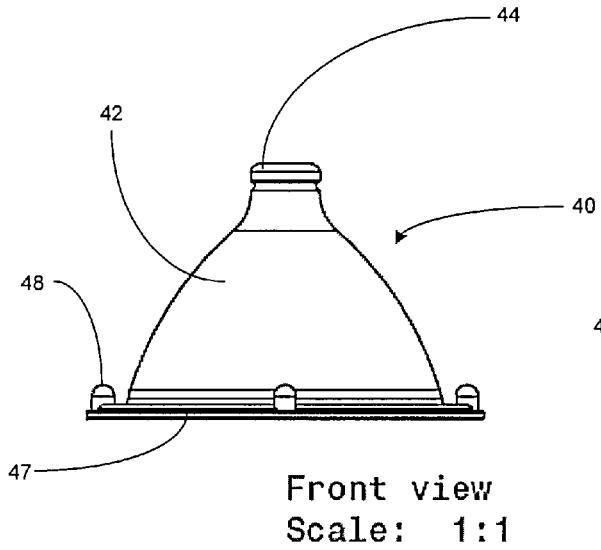
FIGS. 6A-6C are schematic diagrams of various views of an exemplary second or middle nipple.
Figure 6C:
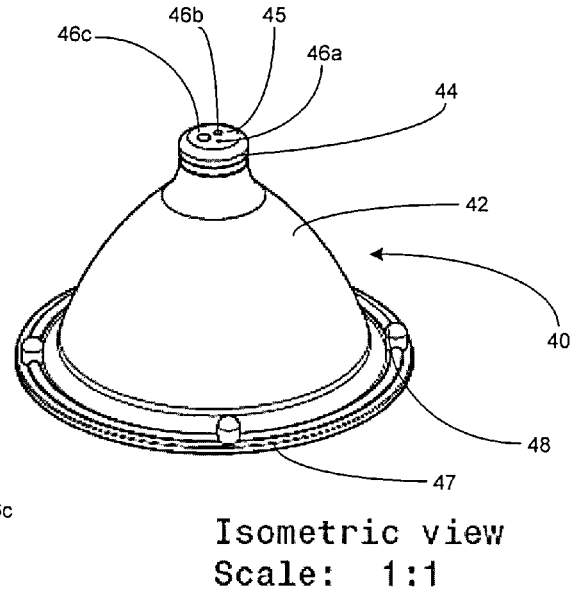
Figure 6B:
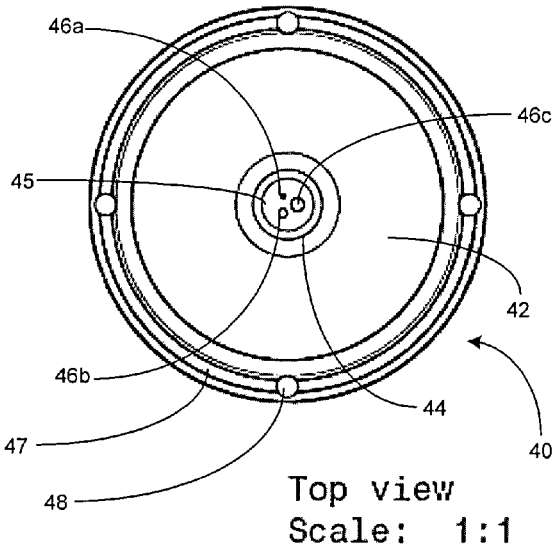

FIGS. 6A-6C are schematic diagrams of various views of an exemplary second or middle nipple 40. The second nipple has a generally conical frame 42 and a tip 44 as is conventional for a baby bottle nipple. The tip 44 has a plurality of selectable setting outlets 46*a-c* that correspond to a commensurate plurality of flow rate settings. As shown, exemplary setting outlets 46*a-c* each constitutes a hole of a different size, thereby permitting different flow rates of a feeding fluid through the middle nipple. For example, setting outlet 46*a* is smallest and represents a lowest relative flow rate, such as may be used for premature babies having a deficient feeding reflex, or by newborns who otherwise may experience difficulty feeding. The setting outlet 46*b* may correspond to a relatively intermediate flow rate, such as may be used with a healthy newborn with typical feeding capabilities. The setting outlet 46*c* is the largest hole and may correspond to an advanced or relatively high flow rate, such as may be used with an older or larger infant with a relatively greater feeding capacity. It will be appreciated that the three-setting configuration of FIGS. 6A-6C may be varied. Setting outlets of other hole sizes and/or numbers may be employed to provide a variety of corresponding flow rate settings. Furthermore, more than one hole may be employed to provide a single flow rate setting. In addition, the tip 44 may have a closed portion 45 that corresponds to an additional setting in which flow is substantially prohibited.

The second or middle nipple 40 may also include a rim 47 having fastening extensions 48. In the example of FIGS. 6A-6C, four fastening extensions are provided and spaced equally about the circumference of the rim 47. The precise number and positioning of the fastening extensions, however, may be varied, but preferably are of equal number and spaced to align with the fastening holes 28 of the fastening ring 22. Thus, the fastening extensions 48 may cooperate with the fastening holes 28 of the fastening ring 22. In this manner, the fastening ring may be secured to the middle nipple in a substantially rigid manner.

Figure 7A:
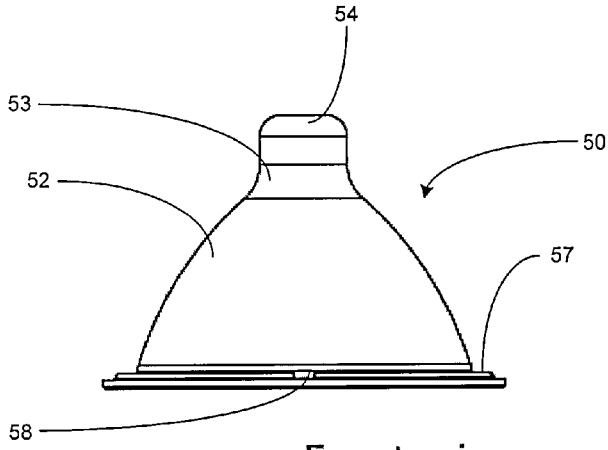
FIGS. 7A-7C are schematic diagrams of various views of an exemplary third or top nipple.
Figure 7C:
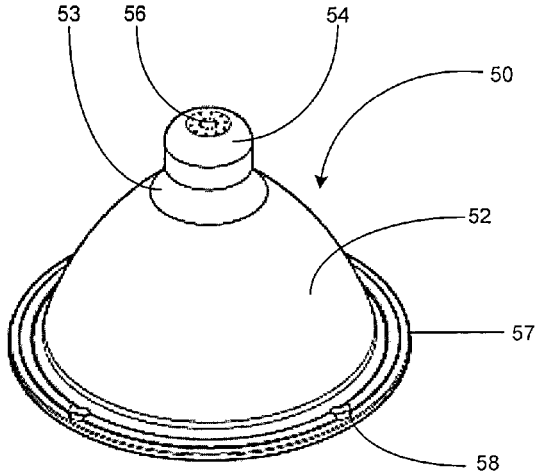
Figure 7B:
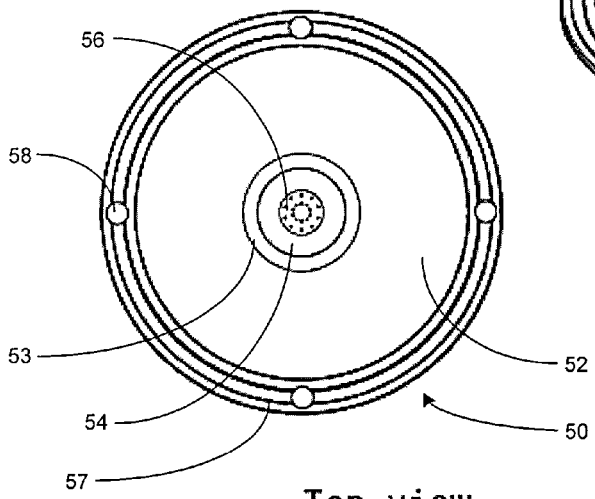

FIGS. 7A-7C are schematic diagrams of various views of an exemplary third or top nipple 50. The third nipple is configured and shaped in a manner that approximates a breast nipple to enhance feeding behavior. The third nipple has a generally conical frame 52, a concave mid portion 53, and a tip 54. To approximate a breast nipple, the overall length of the third nipple is shorter than a conventional bottle nipple. For example, the length of the third nipple 50 may be about half the length of a conventional bottle nipple, or equal to or less than about 34.1 millimeters (1 5/16 inches) in length. As seen in FIG. 7A in particular, the concave mid portion has a curvature opposite to the curvature of the frame 52. This configuration provides for a more natural feel and a better suction for a feeding infant. The tip 54 may include a feeding outlet 56 from which an infant may feed. In one embodiment, the outlet may have a configuration of multiple holes intended to mimic a human breast nipple. Due to the combination of shape and hole configuration, in use the top nipple of the present disclosure may approximate breast feeding more than conventional bottle nipples to reduce feeding disruptions or difficulties that may otherwise occur due to switching between bottle feeding and breast feeding.

The top nipple 50 also may include rim a 57 having fastening holes 58. In the example of FIGS. 7A-7C, four fastening holes are provided and spaced equally about the circumference of the rim 57. The precise number and positioning of the fastening holes, however, may be varied, but preferably are of equal number and spaced to align with the fastening holes 28 of the fastening ring 22, and the fastening extensions 48 of the second nipple 40. Thus, the fastening holes 58 may cooperate with or receive the fastening extensions 48 of the second nipple 40. In this manner, the top nipple may be secured to the middle nipple and the fastening ring in a substantially rigid manner.

Based on the description of the components above, an exemplary bottle 10 may be assembled as follows. The feeding liner 15 may be provided within the bottle base 12 as is conventional, or the bottle base may itself constitute a container for a feeding fluid.

Figure 8:
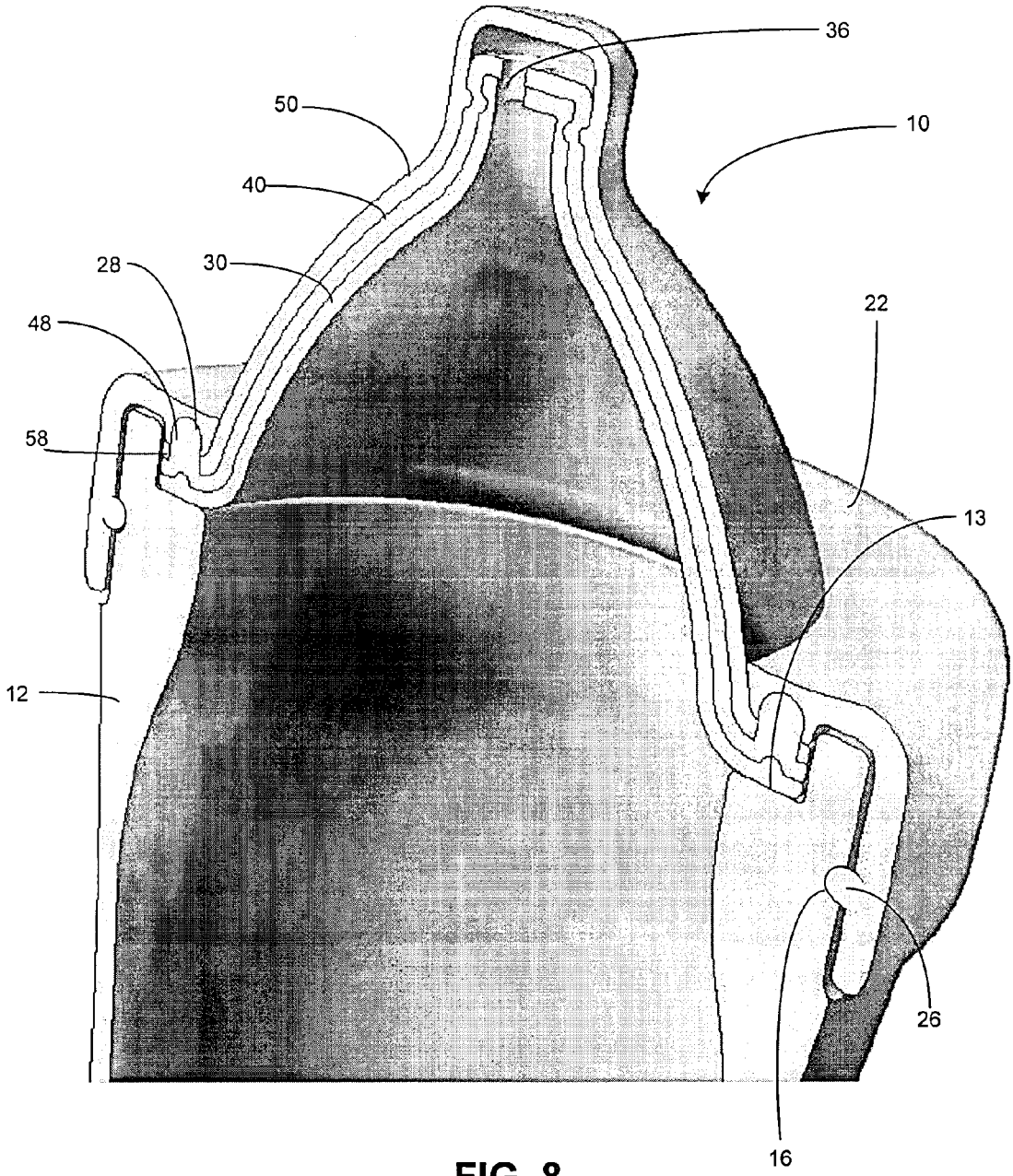
FIG. 8 is a schematic diagram of the cross-section of the upper portion of an exemplary baby feeding bottle.

FIG. 8 is a schematic diagram of the cross-section of the upper portion of an exemplary baby feeding bottle 10. The protrusions 38 of the first or bottom nipple 30 may be snapped into the notches 17 (not seen in FIG. 8) of the bottle base 12. The nipple 30 thus may be secured to the base 12 in a substantially rigid manner, as described above. In other words, the bottle base 12, feeding liner 15, and bottom nipple 30 are moveable as a single piece. In addition, the bottom nipple is positioned to receive fluid from the base or fluid container. Fluid, therefore, may flow from the feeding liner 15 or base 12 into the first nipple 30, and then through the outlet 36 of the first nipple.

Separately, the fastening ring 22, second or middle nipple 40, and top or third nipple 50 may be secured together. The fastening extensions 48 of the middle nipple 40, the fastening holes 28 of the fastening ring 22, and the fastening holes 58 of the top nipple 50 may be aligned. The components may be snapped or pressed together by inserting the fastening extensions 48 of the middle nipple 40 through the fastening holes 58 of the top nipple 50, and into the fastening holes 28 of the fastening ring 22. These components thus may be secured to one another in a substantially rigid manner, as described above. In other words, the fastening ring 22, middle nipple 40, and top nipple 50 are moveable as a single piece.

The combined fastening ring, middle nipple, and top nipple may then be snapped onto bottle base 12 such that the ridge 26 of the fastening ring 22 rests within the groove 16 of the bottle base 12. When the bottle 10 is fully assembled, the three nipples protrude through the upper opening of the fastening ring, with the top nipple enveloping the middle nipple, and the middle nipple enveloping the bottom nipple. In this fashion, the middle nipple is positioned to receive fluid from the bottom nipple, and the top nipple is positioned to receive fluid from the middle nipple. The nipples may rest in this sandwiched or stacked configuration upon the ridge 13 of the bottle base 12, above and adjacent to the top of the fluid liner 15. A fluid connection thus may be established from the feeding liner and/or bottle base, into and through the bottom and middle nipples in turn, and then into the top nipple and through the outlet 56, from which an infant may feed. The various components may maintain the assembled configuration in response to forces occurring during use (feeding). In one embodiment, the bottle 10 may be disassembled in whole or in part into its various components, which permits more thorough cleaning and sterilization.

An exemplary use of the bottle 10 to provide enhanced fluid flow characteristics will now be described. In particular, the fluid flow rate may be adjusted as needed depending upon the feeding circumstances.

For example, suppose a caretaker wishes to feed an infant who is having difficulty or has a deficient feeding capacity, meaning that a low flow rate is warranted. As stated above, the bottle base 12 and bottle nipple 30 are connected in a substantially rigid manner and move as one piece. In addition, the fastening ring 22, middle nipple 40, and top nipple 50 are similarly connected to one another in a substantially rigid manner and move as one piece. However, the groove 16 of the bottle base and the ridge 26 of the fastening ring permit the turning or rotating of the bottle base relative to the fastening ring. As a result, the bottom nipple and middle nipple may be rotated or turned commensurately relative to one another.

As stated above, the outlet 36 of the bottom nipple is offset relative to the center of the tip 34, and the setting outlets 46*a-c* of the middle nipple are similarly offset from the center of the tip 44. By rotating the bottle base relative to the fastening ring, thereby rotating the bottom nipple relative to the middle nipple, the outlet 36 of the bottom nipple may be aligned with one of the setting outlets 46*a*, 46*b*, or 46*c* to select a particular setting outlet. For example, if a relatively low flow rate is desired, a user may turn the bottle base to align the outlet of the first nipple with the smallest setting outlet 46*a*. If an infant has an intermediate feeding capacity, a user may align the outlet of the first nipple with the setting outlet 46*b* for a relatively intermediate flow rate. Similarly, if an infant has an advanced feeding capacity, a user may align the outlet of the first nipple with the setting outlet 46*c* for a relatively advanced or high flow rate. It will be appreciated that to accommodate an advanced flow rate, such as that provided by setting outlet 46*c*, the outlet 36 of the bottom nipple should permit a maximum flow rate that is equal to or exceeds the highest flow rate permitted by the middle nipple. In one embodiment, the fastening ring and/or bottle base may be provided with a visual indicator, such as one or more markers, that indicate to a user the alignment of the bottom and middle nipples so that a desired alignment may be attained. In one embodiment, a user may also align the outlet 36 of the first nipple with the closed portion 45 of the middle nipple, thereby substantially precluding fluid flow. In this manner, the bottle may be essentially "turned off" to reduce the propensity for leaks and spills when an infant is not specifically feeding.

When an infant is feeding, fluid first flows largely under the force of gravity due to the tilt of the bottle from the fluid liner 15 (or bottle base 12 if the bottle base also is the fluid container) into the bottom nipple 30. The outlet 36 of the bottom nipple 30 permits fluid to flow to the middle nipple 40. Depending upon which setting outlet is aligned with the outlet of the bottom nipple, flow through the middle nipple (and into the top nipple) may be altered or reduced relative to the flow through the bottom nipple. An infant feeds through the top nipple, the sucking force drawing in fluid at substantially a flow rate set by the aligned setting outlet of the middle nipple.

A caretaker may also adjust the fluid flow rate during use. For example, suppose a caretaker is to feed an infant known for having a deficient feeding capacity. The caretaker initially may set the flow rate to the lowest setting. As feeding proceeds, the infant may relax or settle into feeding, resulting in a greater feeding capacity. A caretaker may then rotate the bottle base such that the flow rate is set to the next highest setting. In other words, the outlet of the bottom nipple may be realigned to a setting outlet of the middle nipple corresponding to the next increased flow rate. During use, the suckling force of the infant may constitute a holding force to hold the fastening ring, with the middle and top nipples, stationary. The caretaker may then rotate the bottle base, and thereby the bottom nipple, to realign the outlet 36 with an alternate setting outlet to increase the flow rate during use. This ability to alter the flow rate during use provides a convenient way to "train" an infant to improve feeding behavior, which would be more difficult if the bottle had be to removed from the infant to reset the flow rate, thereby disrupting feeding.

In addition to in-use adjustment, the flow rate may be adjusted before use so that the bottle may be reused with numerous infants having varying feeding capacities. Similarly, a parent or home caretaker may adjust the flow rate for a single infant as the infant's feeding capacity increases with development.

It will be appreciated that the bottle of the current disclosure has numerous advantages over known bottles. The bottle of the current disclosure provides for an adjustable flow rate to accommodate the feeding capacities of numerous infants, or the changing feeding capacity of a single infant. In addition, the flow rate may be adjusted in use to provide for "training" an infant who may have a deficient feeding capacity, or may be at a developmental stage when capacity is increasing. The bottle may be readily assembled and disassembled for convenient cleaning, sanitation, and reuse. In addition, adjustability is accomplished without the use of complex valves or comparable systems, thereby reducing manufacturing complexities and cost. By avoiding the use of valve systems, maintenance complexities and the potential for the failure of intricate moving parts may also be reduced. The top nipple also approximates breastfeeding more than conventional nipples, thereby reducing disruptions caused by switching between bottle feeding and breastfeeding.

Although the invention has been shown and described with respect to certain preferred embodiments, it is understood that equivalents and modifications will occur to others skilled in the art upon the reading and understanding of the specification. The present invention includes all such equivalents and modifications, and is limited only by the scope of the following claims.

What is claimed is:

1. A baby bottle comprising:

a base including a container for containing a fluid;

a first nipple secured to the base for receiving the fluid from the container; and a second nipple positioned to receive the fluid from the first nipple;

wherein the fluid is transferred through a tip of the first nipple to the second nipple at a first flow rate, and the fluid is transferred through a tip of the second nipple at a second flow rate different from the first flow rate.

2. The baby bottle of claim 1, wherein the tip of the second nipple comprises a plurality of selectable setting outlets, each outlet corresponding to a different second flow rate such that when one of the setting outlets is selected, fluid flows through the selected setting outlet at its corresponding flow rate.

3. The baby bottle of claim 2, wherein the tip of the second nipple includes three setting outlets corresponding respectively to a low flow rate, an intermediate flow rate, and a high flow rate.

4. The baby bottle of claim 3, wherein the first flow rate through the tip of the first nipple is equal to or exceeds the high flow rate.

5. The baby bottle of claim 2, wherein the first nipple is rotated relative to the second nipple to select one of the setting outlets.

6. The baby bottle of claim 5, wherein the tip of the first nipple includes an outlet positioned off center, and one of the setting outlets is selected by rotating the first nipple relative to the second nipple to align the outlet of the first nipple with the selected setting outlet of the second nipple.

7. The baby bottle of claim 6, wherein the first nipple is rigidly secured to the base, and the base is rotated relative to the second nipple to select one of the setting outlets.

8. The baby bottle of claim 7, further comprising a fastening ring that is rigidly secured to the second nipple, and the fastening ring is longitudinally secured to the base in a manner that permits the fastening ring to rotate relative to the base, wherein the base is rotated relative to the fastening ring to select one of the setting outlets.

9. The baby bottle of claim 1, further comprising a fastening ring that is secured to the second nipple, and the fastening ring is longitudinally secured to the base to position the second nipple above the first nipple.

10. The baby bottle of claim 9, further comprising a third nipple secured to the fastening ring above the second nipple for receiving fluid from the second nipple, the third nipple including a feeding outlet.

11. The baby bottle of claim 10, wherein the feeding outlet has a plurality of holes configured to mimic a human breast nipple to approximate breast feeding.

12. A feeding assembly for a baby bottle comprising:

a first nipple for receiving a fluid from a container; and a second nipple positioned to receive the fluid from the first nipple;

wherein the fluid is transferred through a tip of the first nipple to the second nipple at a first flow rate, and the fluid is transferred through a tip of the second nipple at a second flow rate different from the first flow rate.

13. The feeding assembly of claim 12, wherein the tip of the second nipple comprises a plurality of selectable setting outlets, each outlet corresponding to a different second flow rate such that when one of the setting outlets is selected, fluid flows through the selected setting outlet at its corresponding flow rate.

14. The feeding assembly of claim 13, wherein the tip of the second nipple includes three setting outlets corresponding respectively to a low flow rate, an intermediate flow rate, and a high flow rate.

15. The feeding assembly of claim 14, wherein the first flow rate through the tip of the first nipple is equal to or exceeds the high flow rate.

16. The feeding assembly of claim 13, wherein the first nipple is rotated relative to the second nipple to select one of the setting outlets.

17. The feeding assembly of claim 16, wherein the tip of the first nipple includes an outlet positioned off center, and one of the setting outlets is selected by rotating the first nipple relative to the second nipple to align the outlet of the first nipple with the selected setting outlet of the second nipple.

18. The feeding assembly of claim 17, further comprising a fastening ring that is rigidly secured to the second nipple, wherein the first nipple is rotated relative to the fastening ring to select one of the setting outlets.

19. The feeding assembly of claim 12, further comprising a fastening ring that is secured to the second nipple to position the second nipple above the first nipple.

20. The feeding assembly of claim 19, further comprising a third nipple secured to the fastening ring above the second nipple for receiving the fluid from the second nipple, the third nipple including a feeding outlet.

* * * * *